United States Patent [19]

Gowing

[11] 3,966,014

[45] June 29, 1976

[54] AIR INTAKE SILENCER

[75] Inventor: George A. Gowing, Valcourt, Canada

[73] Assignee: Bombardier Limited, Valcourt, Canada

[22] Filed: Mar. 8, 1974

[21] Appl. No.: 449,449

[30] Foreign Application Priority Data

Nov. 22, 1973 Canada ..... 186483

[52] U.S. Cl. ..... 181/35 A; 123/198 E

[51] Int. Cl.[2] ..... F02F 1/34; F02B 77/00

[58] Field of Search ..... 123/198 E; 181/35 A, 181/56, 59, 60, 57

[56] References Cited

UNITED STATES PATENTS

| | | | |
|---|---|---|---|
| 2,510,440 | 6/1950 | Vokes | 181/35 A |
| 2,510,441 | 6/1950 | Vokes | 181/35 A |
| 3,557,902 | 1/1971 | Brown et al. | 123/198 E X |
| 3,712,416 | 1/1973 | Swanson et al. | 181/35 A |
| 3,810,526 | 5/1974 | Kawasaki | 123/198 E X |
| 3,826,332 | 7/1974 | Tuckey | 181/57 X |
| 3,835,956 | 9/1974 | Kishira | 181/57 X |

FOREIGN PATENTS OR APPLICATIONS

| | | | |
|---|---|---|---|
| 1,526,699 | 9/1970 | Germany | 123/198 E |

*Primary Examiner*—Charles J. Myhre
*Assistant Examiner*—Ira S. Lazarus

[57] ABSTRACT

An air intake silencer for an internal combustion engine of the two-stroke cycle type, for example a snowmobile engine, comprising a housing for connection to the intake side of the engine carburetor, and a filter chamber and resonance chamber defined within the housing to filter out engine noise in high and low frequency ranges. An intake duct of smooth uninterrupted tubular configuration extends in an axial direction through the housing and has a perforate tube section through which the incoming air is smoothly distributed to the filter chamber. The resonance chamber is separated from the filter chamber by means of a perforated baffle plate, the dimensions and volume of the chambers being selected to correspond to the frequency ranges of the noises to be eliminated.

11 Claims, 2 Drawing Figures

AIR INTAKE SILENCER

FIELD OF THE INVENTION

This invention relates to a new or improved air intake silencer for a two stroke cycle internal combustion engine. The silencer can be attached to the engines of vehicles such as motorcycles and snowmobiles.

DESCRIPTION OF THE PRIOR ART

The increasingly strict application of noise control laws in various states has led to a considerable reduction in the level of exhaust noise emanating from vehicles such as snowmobiles, to the extent that to obtain further reduction in the noise of such vehicles in operation, it is necessary to reduce not just exhaust noises, but also noises emanating from the engine through the carburetor and air intake.

SUMMARY OF THE INVENTION

According to the invention there is provided an air intake silencer for an internal combustion engine of the two-stroke cycle type for connection to the intake side of the engine carburetor, comprising: (a) a housing having outlet means for communication with said carburetor means, said housing defining a first chamber of elongate form transversely of said outlet means, and having an inlet opening at one end, (b) a tubular inlet duct extending through said inlet opening and having a perforate section extending within said first chamber transversely of said outlet means and terminating close to the opposite end of said first chamber, (c) one wall of said first chamber being defined by a perforate plate on the opposite side of which is a resonance chamber which communicates with the first chamber through the perforations in said wall but is otherwise closed.

The silencer is preferably manufactured substantially entirely in a suitable rigid or semi-rigid plastics material, such as polyethylene, the housing preferably being of elongate tubular form with the tubular inlet duct and perforate section thereof extending in the axial direction of the housing, and one or more peripheral outlets, for example opening radially from the housing, for connection each to an engine carburetor. In such an arrangement the resonance chamber is preferably formed as an extension of the housing, being separated from the first chamber by a transverse perforated wall, the inlet duct having an inperforate section extending through the resonance chamber and the perforate section being contained in the first chamber from which the carburetor outlet means open.

Where two or more carburetors are to be connected to the air intake silencer, it is preferred to arrange for the carburetor outlets to be spaced longitudinally from one another, and to be positioned at equal distances from the perforate section of the inlet duct.

For optimum results, the silencer should be tuned to the requirements of the engine to which it is to be attached. Silencing effect is obtained from the volume itself of the first chamber, since it slows down and smooths out the transfer of air from the exterior to the carburetor, from the indirect route noise must travel to escape, and from the diameter and length of the inlet duct which itself filters out some noise as does the resonance chamber. If the silencer is not correctly tuned with respect to the engine, an unacceptably high loss of engine output can result. Facts to be taken into consideration in the design of the silencer include the displacement and output of the engine as well as its general configuration (especially the crankcase volume) and the type and number of carburetors. The noise reduction effectiveness of the silencer, and the engine output, are not acutely sensitive to minor variations in the volume and other dimensions of the air silencer, unless such variations tend to physically restrict the air flow into and through the silencer. To minimize losses in engine output, the flow through the silencer should be as smooth as possible, and sharp bends or restrictions in the flow path should be avoided.

With the tubular configuration of silencer housing discussed above, it has been found that loss of engine output can be minimized, and in some cases substantially eliminated, by positioning the perforate section of the inlet duct not axially within the first chamber but rather in an eccentric position displaced towards the side of the housing opposite to the location of the carburetor outlets.

It has been found that air silencers of the type under consideration act to trap fuel which is normally "sprayed-back" by the carburetors and wasted. The fact that this sprayed back fuel is retained and utilized eliminates a potential fire hazard, since the spray back would otherwise accumulate within the confines of the vehicle. In the engine fitted with an air intake silencer, normal carburetor calibration will result in the engine being supplied with too rich a mixture since the sprayed back fuel is not lost, but is rather retained in the silencer and returned in the engine. Similarly, in an engine where the carburetor is calibrated to run with an air silencer, removal of the air silencer will result in the engine being supplied too lean a mixture, which may damage the engine.

BRIEF DESCRIPTION OF THE DRAWING

The invention will further be described, by way of example, with reference to the accompanying drawing in which.

DESCRIPTION OF THE PREFERRED EMBODIMENT

Figure 1:
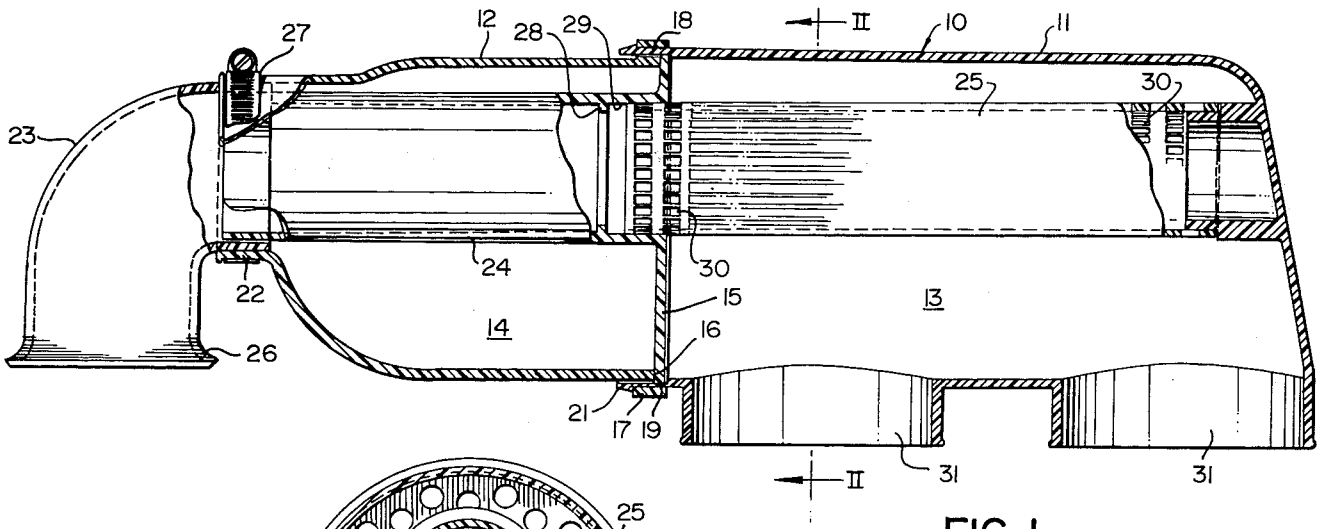
FIG. 1 is a longitudinal sectional view illustrating a preferred embodiment of air intake silencer.
Figure 2:
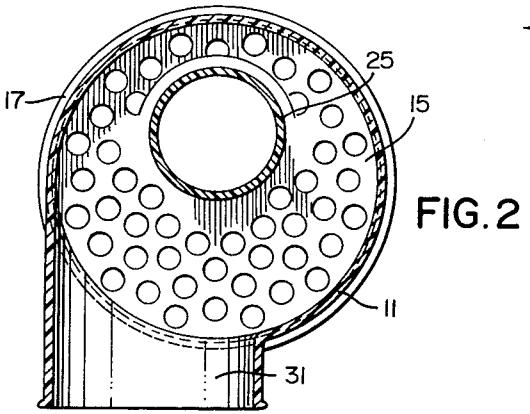
FIG. 2 is a sectional view taken on the line II-II in FIG. 1.

In the drawings, the air intake silencer consists of an elongate, generally tubular housing, indicated at 10. The housing comprises a first section in the form of a filter shell 11, and a second section in the form of a resonator shell 12, connected together in end-to-end relationship as shown. Each of the housing sections is hollow, the filter shell defining a filter chamber 13, and the resonator shell defining a resonator chamber 14, these chambers being separated by a common wall in the form of a transaxially arranged baffle plate 15. As shown in FIG. 2, the baffle plate is circular in form and has an outer periphery which is received in an annular seat 16 in one end of the resonator shell 12. An annular ring 17 surrounds that end of the resonator shell and defines a circumferential wall of the seat 16, the ring being at a uniform radial spacing from the outer wall of the resonator shell. The filter shell, resonator shell, and baffle plate are secured together by means of short arcuate fingers 18, there being four fingers in all, uniformly spaced around the periphery of the filter shell. Alternatively the chambers could be secured together by other suitable means, eg. fasteners such as rivets, or by plastic welding (ultrasonic or heat gun). The fingers 18 project axially through corresponding short arcuate notches 19 in the periphery of the baffle plate 15, and through registering slots in the radial wall of the annular seat 16 in the end of the resonator shell. As shown in FIG. 1, in the assembled condition of the silencer, the fingers 18 extend through the annular space between the ring 17 and the outer surface of the resonator shell, each finger having a thickened head portion 21 which forms a detent engaging behind the end of the ring 17, and preventing accidental separation of the components. The filter shell, resonator shell and baffle plate are preferably molded in a semi-rigid plastics material such as polyethylene, the design being such that the resilience of this material will cause the fingers 18, once inserted through the notches 19, the registering slot and the annular space, to be pressed outward so that their heads 21 engage against the rear surface of the ring 17.

Extending away from the baffle plate 15, the resonator shell has a straight cylindrical portion which tapers smoothly through a curved section to a short eccentrically positioned cylindrical neck 22 at its opposite end. The inlet duct of the air silencer is constituted by an intake elbow 23, an intake tube 24 and a perforate extension tube 25. The intake elbow has at one end a flared mouth 26, and has its other end received in closely fitting relationship within the neck 22 of the resonator shell. Within that other end of the intake elbow, one end of the intake tube 24 is received with a snug fit, the elbow, intake tube, and neck of the resonator shell being secured together by any suitable means, for example, as shown, by means of a contracting band screw clamp 27.

As shown, the plastic intake tube 24 is formed integrally with the plastic baffle plate 15 and extends at right angles thereto in an eccentric position within the resonator chamber 14. However, if desired the intake tube and baffle may be separate parts, and may be formed of other suitable materials, eg. metal. The intake tube is substantially imperforate, and includes an internal annular lip 24 close to the baffle plate 15 as shown. The section of the intake tube to the right of the lip 28 as shown in FIG. 1 defines a seat for the perforate extension tube 25 of the inlet duct. This extension tube is disposed in the axial direction of the filter shell 11 and has its opposite end received on and supported by an annular socket 29 molded integrally with the filter shell 11. The socket 29 thus effectively seals that end of the extension tube, but the latter is perforated throughout its length by rings of closely spaced apertures 30.

Axially spaced on one side of the filter shell 11 are two, radially directed, large diameter outlet openings 31 defined by short cylindrical walls, these openings being designed for connection each to a carburetor of a two cylinder two stroke snowmobile engine (not shown).

It will be noted that the perforate extension tube 25 is not centrally positioned within the generally tubular filter chamber 13, but rather is eccentrically arranged, being displaced away from the outlet openings 1 towards the opposite side of the wall of the filter shell 11. This positioning of the perforate extension tube has been found in some instances to result in a reduction in the loss of engine output caused by the use of an air intake silencer, although a centrally positioned tube generally provides acceptable results.

As will be appreciated, the precise volumes and dimensions of the components of the silencer must be related to the engine for which it is designed. The silencer illustrated in the drawings is one designed for use with a two cylinder two stroke snowmobile engine developing approximately 50 horsepower. For this purpose it has been found that best results are obtained with an inlet duct having an outer diameter in the range of 1.5 to 1.75 inches. As can be seen, the intake duct is substantially straight, without any sharp bends or other restrictions. The dimensions and volume of the filter chamber 13 are designed to filter out noise waves in the frequency range of about 1,000 Hz. The diameter of the filter shell is approximately 5 inches and its length 9 inches.

The resonator chamber 14 is designed to filter out low frequency noise centered around 500 Hz. For this purpose the baffle plate 15 is provided with approximately 44 holes of 0.375 inches diameter distributed as shown in FIG. 2.

The method used for calculating the volumes of the chambers, and other dimensions of the air silencer are complex and at best give only approximate results. Thus, for optimum efficiency, the air intake silencer illustrated would require modification to match the characteristics of the engine with which it is to be used, particularly with respect to the frequency ranges of engine noise to be tuned out in the filter chamber 13 and resonator chamber 14. However, it is believed that the principles of design embodied in the illustrated air silencer, including the straight through configuration of the inlet duct, the low frequency resonator chamber, and the eccentric mounting of the perforate tube extension tube of the duct, are of general application in air silencers of this type.

I claim:

1. An air intake silencer for an internal combustion engine of the two-stroke cycle type and having outlet means for connection to the intake side of engine carburetor means, comprising:

a. a housing having said outlet means, said housing defining a first chamber of elongate form transversely of said outlet means, and having an inlet opening at one end, b. a tubular inlet duct extending through said inlet opening and having a perforate section extending within said first chamber transversely of said outlet means and terminating close to an end of said first chamber opposite to said inlet opening, c. one wall of said first chamber being defined by a perforate plate on an opposite side of which is a resonance chamber which communicates with the first chamber through perforations in said one wall but is otherwise closed.

2. A silencer according to claim 1 wherein said housing comprises a generally tubular wall, said perforate section of the inlet duct extending in a direction axially of the tubular wall.

3. A silencer according to claim 2 wherein said resonance chamber is defined within and at one end of the housing, said one wall of the first chamber comprising a baffle plate arranged in said housing with said inlet duct normal to the baffle plate and extending therethrough.

4. A silencer according to claim 3 wherein said outlet means is positioned radially in the tubular wall of said housing and wherein said perforate section of the inlet duct is positioned eccentrically in the housing being spaced further from the outlet means than from the side of the housing opposite to the outlet means.

5. A silencer according to claim 3 wherein said outlet means comprises two outlet apertures spaced apart axially of the tubular wall.

6. A silencer according to claim 3 wherein said outlet means comprises two outlet apertures spaced apart axially of the tubular wall and positioned radially in the tubular wall of the housing, said perforate section of the inlet duct being positioned eccentrically in the housing and spaced further from the outlet apertures than from the tubular wall of the housing opposite to the outlet apertures.

7. A silencer according to claim 1 wherein the dimensions of said resonance chambers and of said perforations in said one wall of said first chamber are such as to filter out sound waves in the region of 500 Hz, and the dimensions of said first chamber and of perforations in said inlet duct are such as to filter out sound waves in the region of 1000 Hz.

8. A silencer according to claim 3 wherein said housing and inlet duct are fabricated substantially entirely in a suitable rigid or semirigid plastics material.

9. A silencer according to claim 3 wherein said inlet duct has a swivel mounted intake section to permit adjustment of the region from which intake air is drawn.

10. A silencer according to claim 1 wherein said resonance chamber is defined within said housing, said one wall of the first chamber comprising a baffle plate arranged in the housing, said inlet duct extending through and normal to said baffle plate.

11. A silencer according to claim 1 wherein said perforate section of the inlet duct is displaced from the centre of said first chamber to a position further from one side of said first chamber where said outlet means is located than from an opposite side of said first chamber.

* * * * *